United States Patent [19]

Gach et al.

[11] Patent Number: 4,826,026

[45] Date of Patent: May 2, 1989

[54] CHILD RESISTANT DISPENSING CLOSURE

[75] Inventors: Peter P. Gach; Gary V. Montgomery, both of Evansville, Ind.

[73] Assignee: Sunbeam Plastics Corporation, Evansville, Ind.

[21] Appl. No.: 185,080

[22] Filed: Apr. 22, 1988

[51] Int. Cl.[4] ..... B65D 55/02; A61H 1/00

[52] U.S. Cl. ..... 215/206; 215/216; 215/237; 222/153

[58] Field of Search ..... 215/206, 216, 219, 235, 215/237; 222/153; 220/281

[56] References Cited

U.S. PATENT DOCUMENTS

| | | | |
|---|---|---|---|
| 3,604,585 | 9/1971 | Towns . | |
| 3,934,744 | 1/1976 | Curry | 215/219 |
| 4,047,495 | 9/1977 | O'Brian | 215/224 |
| 4,209,100 | 6/1980 | Uhlig | 215/216 |
| 4,220,262 | 9/1980 | Uhlig | 222/153 |
| 4,257,537 | 3/1981 | Uhlig | 222/153 |
| 4,444,326 | 4/1984 | Musel | 215/209 |
| 4,467,931 | 8/1984 | Gach | 215/237 |
| 4,513,888 | 4/1985 | Curry | 222/153 |
| 4,533,058 | 8/1985 | Uhlig | 215/216 |
| 4,629,081 | 12/1986 | McLaren | 215/206 |
| 4,723,669 | 2/1988 | Barriac | 215/206 |

FOREIGN PATENT DOCUMENTS 1527812 10/1978 United Kingdom .

*Primary Examiner*—George T. Hall

*Attorney, Agent, or Firm*—Irvin L. Groh; Alfred L. Patmore, Jr.

[57] ABSTRACT

A dispensing closure molded with polypropylene or other suitable plastic material having a base cap with a dispensing orifice in its top and a lid hinged to the cap for closing the orifice. The lid has a low profile with its skirt conforming with the cap skirt in its closed position so that the lid cannot be grasped with sufficient force to open the lid. An arcuate slot in the cap top allows inward deflection of the cap skirt providing access to the bottom of the lid for swinging the lid open.

25 Claims, 3 Drawing Sheets

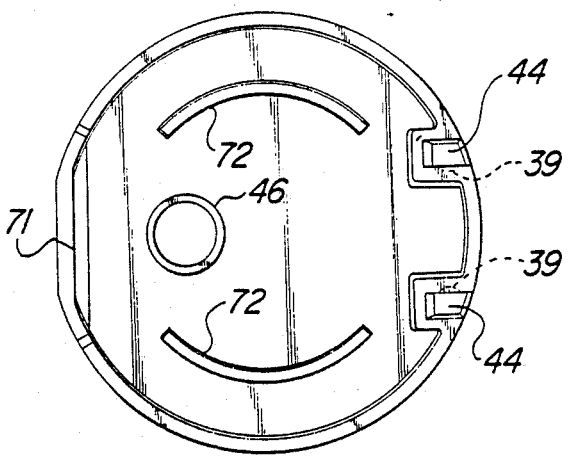
Fig-9
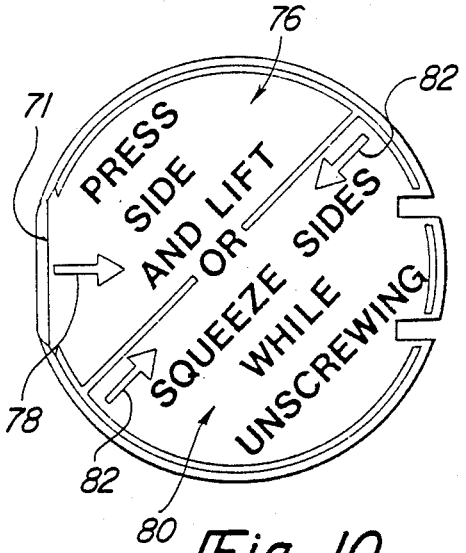
Fig-10
Fig-11
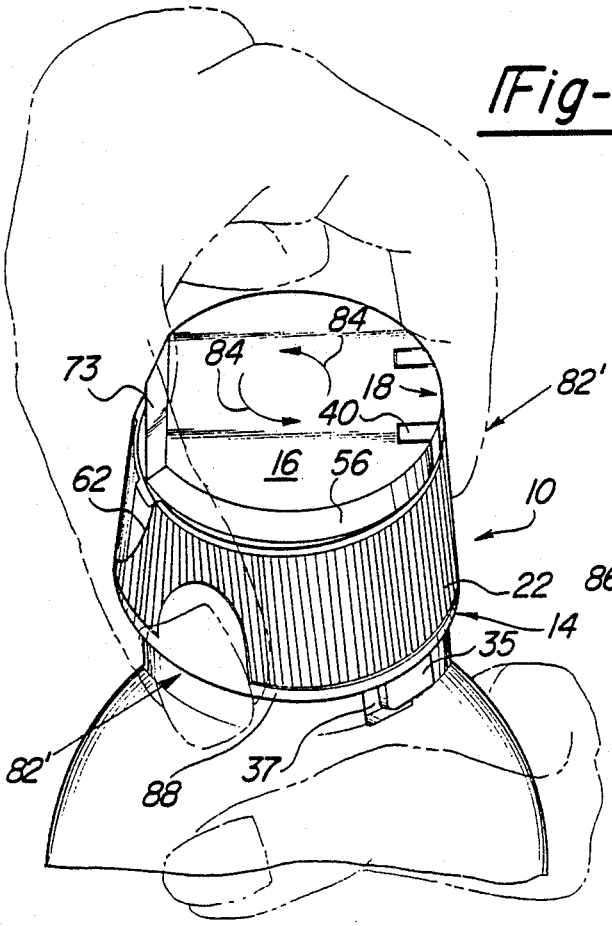
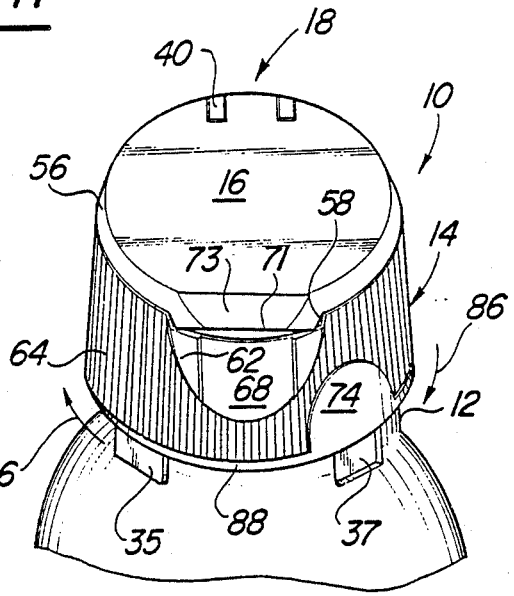
Fig-12

CHILD RESISTANT DISPENSING CLOSURE

This invention relates to a dispensing closure, and more particularly, to a child resistant dispensing closure.

There are a wide variety of child resistant closures available. Whether or not the closure is made of two or more pieces that need to be pre-assembled before application to a container, and whether or not the closure is of the dispensing type, the most successful child resistant closures require two separate and dissimilar movements or actions to open or remove the closure. These movements may be simultaneous or sequential.

In the case of a dispensing closure, a base cap is normally provided with a dispensing orifice located in its top, and a lid member is hinged to the base cap for swinging between a closed position covering the orifice and an open position for dispensing the product therethrough.

By providing alignment of the lid with the base cap or recessing the lid in the base cap top when the lid is in its closed position covering the dispensing orifice, a child resistant feature is effected. The lid cannot be grasped to exert an opening force without a first movement or action to expose an edge of the lid so that a second movement or action can be applied to swing the lid to an open dispensing position. There are a number of these aligned or recessed lid child resistant dispensing closures available.

In some of the available closures, the initial force is applied by finger pressure exerted against the top of the closure lid to expose an edge of the lid for application of a second pivotal opening force. The disadvantage of this type of closure is that the downward force may be inadvertently applied by the child by banging or dropping the closure on a hard surface. Closures which provide an initial finger purchase by squeezing a portion of the base cap have overcome this "accidental opening" disadvantage of a top force actuated closure. Application of a lateral squeezing force to the closure skirt wall, pushing the wall inwardly to release a lid latch or to provide a finger purchase on the lid has been implemented in a number of closures by providing a recess in the base cap wall. Since it is difficult to provide sufficient side wall displacement with a skirt wall recess, particularly where the base cap has a plug seal to the container neck, additional expediencies have been incorporated to increase displacement. Scoring or slotting the skirt wall within the circumferential extent of the slot has been used to enhance movement with the sacrifice of side wall integrity.

The instant invention overcomes the disadvantages of the prior art structures in a dispensing closure in which the base cap has a top with a dispensing orifice and an annular cap skirt and a lid which has a depending skirt aligned with the annular cap skirt or inside the cap skirt in a recess, and the lid contacts the cap top when the lid is in the closed position covering the dispensing orifice. Preferably the lid is molded separately from the base cap and the two are assembled by a spaced post and slot hinge. This provides a sturdy, well aligned, hinge not subject to the fatigue failures of living hinges. However, the closure of the instant invention can utilize an integrally molded lid and base cap joined by a strap or live hinge.

In a preferred embodiment of the invention the lid is formed with a closure plug depending from its top which engages the dispensing orifice to seal it when the lid is in its closed position. The plug may also cooperate with the dispensing orifice to retain the lid in its closed position to prevent accidental opening of the lid. The base cap is preferably provided with means for permanently attaching it to the container neck so that dispensing must take place through the dispensing orifice.

In a preferred form of the invention, the base cap has an inner skirt concentric with the outer skirt. The inner skirt is internally threaded for engagement with complementary threads on the container neck. The outer skirt is provided with means for permanent or semi-permanent attachment to the container. Preferably, this takes the form of a tab which depends from the outer cap skirt which engages a stop or recess on the container neck which prevents unthreading of the base cap from the container neck. Preferably, two diametrically opposed tabs extending axially from the bottom of the cap skirt are used to engage two recesses in the container neck. The tabs are preferably located in a plane at an angle to or normal to a plane through the dispensing orifice and hinge.

To provide a positive displacement of the cap skirt when finger gripping pressure is applied to the skirt at a point opposite and in alignment with the hinge and dispensing orifice, an arcuate slot extends through the cap top between the dispensing orifice and the cap skirt centered on a line with the dispensing orifice and the hinge. In the preferred embodiment utilizing an inner skirt, the arcuate slot extends through the cap top between the inner and outer cap skirts. Where the base cap is recessed as by extending the cap skirt upwardly from the cap top, the arcuate slot can be contiguous with the cap skirt.

Where diametrically opposed tabs are used to secure the base cap to the container, provision can be made for child resistant removal of the cap by locating pressure spots on the bottom portion of the cap skirt in a plane normal to the plane of the tabs so that the base cap can be removed by simultaneously squeezing the spots and unscrewing the base cap.

The preferred embodiments of the inventions are illustrated in the drawing in which:

FIG. 9 is a bottom plan view of the lid showing

FIG. 9 is a bottom plan view of the lid showing arcuate ribs for contacting the base cap top and the details of the hinge slot structure;

FIG. 10 is a top plan view of the lid showing primarily an opening instruction legend;

Figure 4:
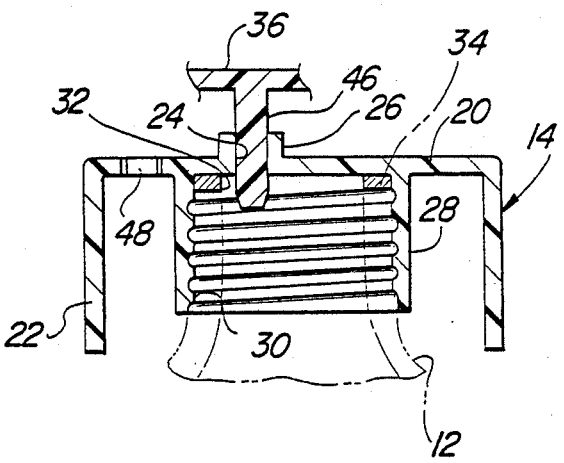
FIG. 4 is a sectional elevational view taken along line 4—4 of FIG. 3 showing a portion of the lid with its plug engaged with the dispensing orifice and the means of sealing the closure to the container neck.
Figure 5:
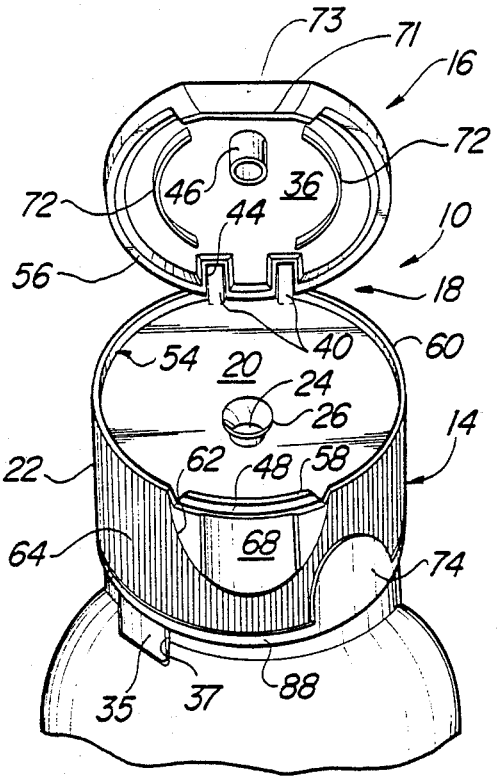
FIG. 5 is a perspective view of another embodiment of the closure of this invention showing a recessed top into which the lid fits in its closed position with the lid shown in an opened dispensing position.

FIG. 11 is a perspective view of the embodiment of the closure shown in FIG. 5 further showing the application of squeezing force to the cap skirt and the direction of base cap rotation for removal of the base cap from the container neck; and FIG. 12 is a perspective view of the closure of FIG. 5 showing the lid in its closed position in the base cap recess, and the base cap being threaded on before capture of the base cap tabs in the container neck recesses. Referring to the drawing, and particularly to FIGS. 1-4, dispensing closure 10 is shown attached to container neck 12. Closure 10 includes a base cap 14, a lid 16 and connecting hinge 18. The base cap, lid and hinge can be integrally molded with the hinge 18 being of the so-called living or live type, or the base cap and lid can be separately molded utilizing the illustrated preferred spaced post and slot hinge shown best in FIGS. 1 and 3.

Base cap 14 has a planar top 20 and an annular or cylindrical side wall 22 extending downwardly from the perimeter of the cap top. A dispensing orifice 24 extends through the cap top 20, and, in the preferred form, a nozzle 26 surrounds the orifice and extends upwardly from the cap top 20 to direct the product being dispensed.

As best seen in FIG. 4, base cap 14 has a second or inner skirt 28 concentric with cap skirt 22 containing internal threads 30 which engage complementary threads on the container neck. In order to seal the base cap 14 to the container neck 12, an annular gasket 32 is interposed between the lip 34 of the container neck 12 and the underside of cap top 20.

In order to attach base cap 14 to the container neck 12 in a manner that it is not easily removed, a pair of diametrically opposed tabs 35 depend downwardly from cap skirt 22 to engage slots 37 in the container neck to prevent unthreading of the base cap so that dispensing must take place through the dispensing orifice 24. Where there is no intention to instruct the user how to remove the base cap, the tabs 36 and cooperating stops or slots 38 are positioned in a plane normal to a plane through dispensing orifice 24 and hinge 18. In other instances, where a child resistant removal of the base cap is provided, as illustrated in FIGS. 5-12, the tabs will have a different preselected orientation.

It will be appreciated that other means can be used to permanently or semi-permanently attach the base cap 14 to the container neck 12. For example, gasket 32 can take the form of a metallic foil with a heat sealing compound on each side so that after the cap has been threaded onto the container neck, the foil can be inductively heated to fuse the cap top 20 to the container lip 34 so that the gasket 32 now becomes the permanent attachment means as well as performing the sealing function. Axially extending tabs 35 can take the form of ratchet teeth to engage corresponding teeth on the neck finish, or they could be replaced by ratchet teeth on the container lip 34 which engage corresponding teeth on the cap top 20 at the location of annular gasket 32 as set forth in copending patent application Ser. No. 026,206, filed Mar. 16, 1987. Axially extending tabs 35 could also be made in the form of radially inwardly or outwardly extending tabs to engage corresponding radially extending stops or slots 37 on the container neck finish. While a threaded closure is preferred, the base cap 14 could be made with an inwardly directed bead at the bottom of cap skirt 22 which engages a corresponding flange on the container neck finish to provide a snap bead connection, in which case, the inner skirt can be eliminated or can be made in the form of a plug to sealingly engage the interior of the container neck as set forth in copending patent application Ser. No. 023,832, filed Mar. 9, 1987.

Figure 1:
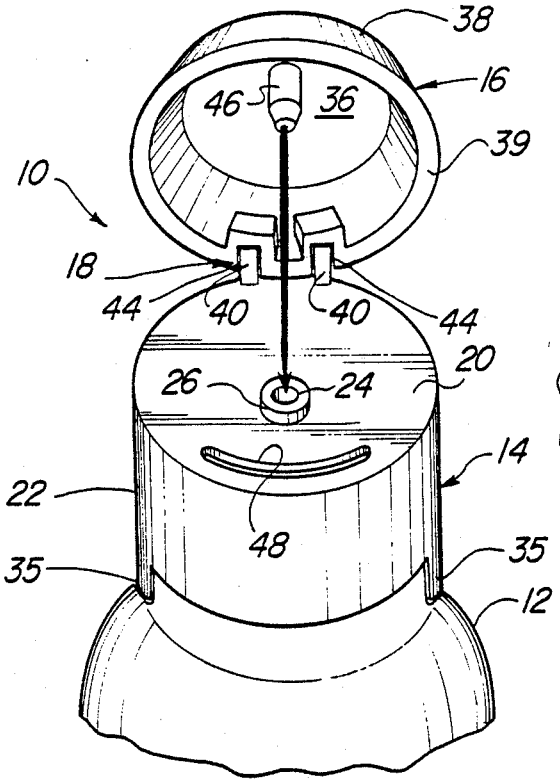
FIG. 1 is a perspective view showing the closure of this invention attached to a container neck with the lid in an open dispensing position.
Figure 2:
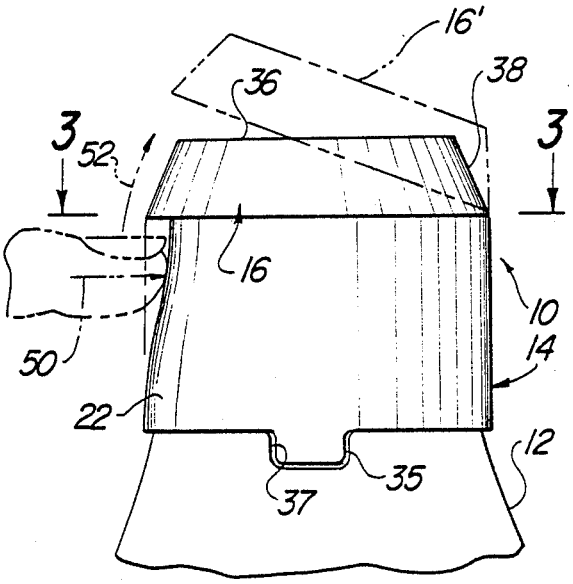
FIG. 2 is a side elevational view showing the closure with its lid in a closed position and showing the application of an opening force by the user's finger moving the cap skirt inwardly to obtain a finger purchase for the lifting movement.
Figure 3:
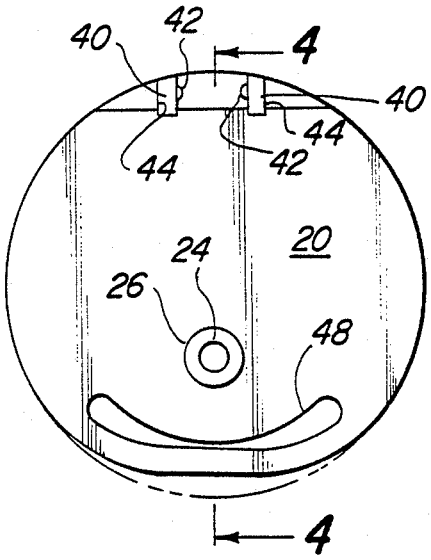
FIG. 3 is a plane view of the base cap with the lid removed taken along line 3—3 of FIG. 2 showing the deflection of the base cap top by the inward movement of the cap skirt and further showing the details of a preferred hinge structure.

Lid 16 has a planar top 36 and a side wall 38 which preferably takes the form of an annular skirt which depends downwardly from the periphery of lid top 36 and diverges outwardly to be in substantial alignment with cap skirt 22 when the lid 16 is in a closed position in contact with the cap top 20. As best seen in FIG. 1, annular rim 39 at the bottom of annular lid skirt 38 will contact cap top 20 adjacent its perimeter. Closure plug 46 extends downwardly from lid top 36 to sealingly engage dispensing orifice 24 when the lid 16 is in its closed position. Plug 46 can also serve to retain the lid 16 in its closed position. The height of lid side wall 38 accommodates the plug 46 and dispensing nozzle 26 but is relatively small so as to present with the diverging angle a low profile lid which cannot be grasped with sufficient force to open the lid.

The preferred spaced post and slot hinge takes the form of a pair of posts 40 extending upwardly from base cap top 20 having curvilinear projections 42 which are in line with each other and engage corresponding slots 44 and curvilinear depressions 43, see FIG. 9, in the portion of side wall 38 forming slots 44. The lid 16 pivots about a hinge axis through the center of projections 42 from a closed position covering and sealing the dispensing orifice 24 to an open dispensing position as shown in FIG. 1 which is approximately 90° to the cap top 20 where the hinge posts 40 and slots 38 do not extend through the lid top 36. where the posts and slots do extend through the lid top as shown in the embodiment of FIGS. 5-12, the lid can be swung to a full 180° open position. Details of this preferred hinge are set forth in U.S. Pat. No. 4,666,068.

Arcuate slot 48 extends through base cap top 20 and is centered in line with dispensing orifice 24, nozzle 26 and hinge 18. Slot 48 is closely adjacent to cap skirt 22, being located between the cap skirt 22 and the inner skirt 28. The closure 10 is opened for dispensing by applying a finger pressure to the cap skirt as indicated by arrow 50 in FIG. 2 causing the cap skirt to move inwardly as shown so that a finger purchase is created under lid 16. The user's finger can then be moved upwardly, as shown by arrow 52 in FIG. 2, to lift the lid 16, swinging or pivoting it in a opening direction about hinge 18 as indicated by the phantom position 16' of the lid in FIG. 2 to a fully opened dispensing position. The width of slot 48 controls the desired displacement which can be of the order of the wall thickness of cap skirt 22 or more. The arcuate length of slot 48 is controlled to some extent by the flexibility of the material from which the cap is molded, but will normally be at least 45° and preferrable will be about 60° with a maximum of 90°. With the slot being located in the base cap top 20 instead of the cap skirt, sufficient displacement can be obtained without compromising the integrity of the skirt wall 22.

In the most common closure sizes of 1" to 1½" diameter, the low profile lid will have a height of 0.1" to 3/16". In the embodiment as shown in FIGS. 1–4, the lid 16 has been intentionally shown to be on the high side with the low profile being enhanced to prevent grasping by the taper or divergence of the lid skirt which can be of the order of 20° from the vertical. This angle also precludes opening by a child's teeth.

Figure 6:
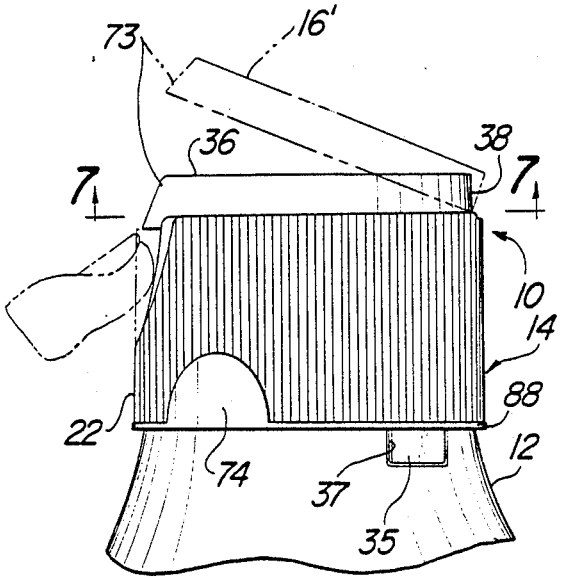
FIG. 6 is a side elevational view showing the closure of FIG. 5 with its lid in a closed position and showing the application of an opening force by the user's finger moving the cap skirt inwardly to obtain a finger purchase for the lifting movement.
Figure 7:
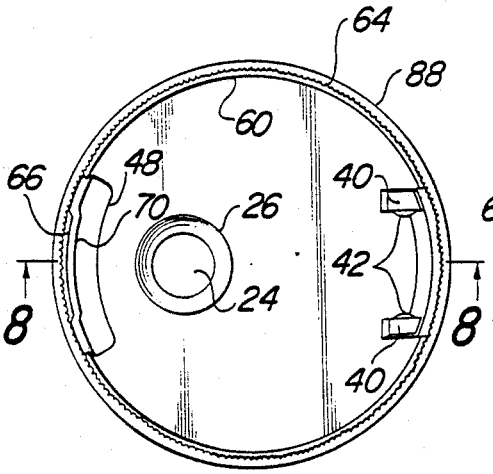
FIG. 7 is a plan view of the base cap of FIG. 5 with the lid removed taken along line 7—7 of FIG. 6 showing the details of a arcuate slot which is contiguous with the cap skirt, a thin wall section opposite the arcuate slot, and showing the details of a perferred hinge structure.
Figure 8:
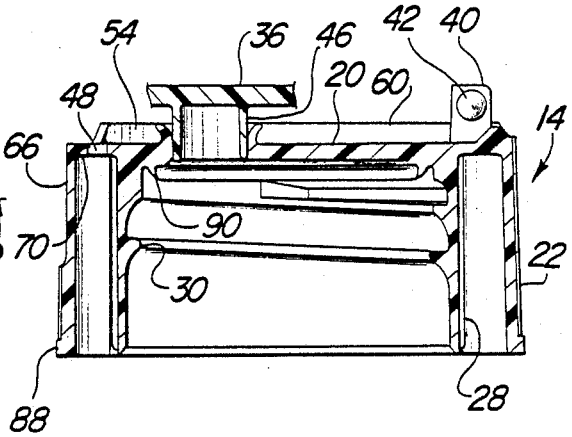
FIG. 8 is a sectional elevational view taken along line 8—8 of FIG. 7 showing a portion of the lid with its plug engaged with the dispensing orifice, the thin cap skirt wall section opposite the arcuate slot and an annular fin for sealing the closure to the container neck.

Other techniques and structures can be used to decrease the possibility of a child grasping the low profile lid or biting it with sufficient force to open the lid. In the embodiment of the invention shown in FIGS. 5–12, base cap 14 is recessed at 54 to receive the lid side wall 56 in conforming relationship to the cap skirt 22. Lid sidewall 56 is a straight annular skirt which fits in close conformity or contiguously inside of an upperwardly extending portion 60 of cap skirt 22. Here arcuate slot 48 is contiguous with the inside of cap skirt 22. The upwardly extending cap skirt 60 is discontinuous opposite slot 48 to provide an opening 58 allowing the cap skirt to be pushed in under lid 36 to provide a finger purchase as shown in FIG. 6.

The general area where the cap skirt is to be pushed inwardly opposite the slot 48 is indicated at 62 by a change in the closure finish from the knurled portion of the cap skirt at 64 to a smooth finish in the area 62. In order to reduce the force required to push the cap skirt wall in, the wall thickness is reduced at 66 opposite the central portion of slot 48 to define a finger push area 68 directly in line with the dispensing orifice 24 and hinge 18.

The straight annular lid sidewall of the closure shown in FIGS. 5–12 is narrower than the diverging sidewall 38 of the embodiment shown in FIGS. 1–4. In order to further reduce the possibility of a child biting the cap open in the slot area 58, the front portion of the lid opposite the arcuate slot 48 is cut off as a cord at 71 and is slopped rearwardly at 73 at an angle of approximately 20°. Cap skirt 22 is provided with an inwardly projecting lip 70 opposite arcuate slot 48 so that the lid skirt 56 superimposes the lip when the lid is in its closed position. A pair of opposed arcuate ribs 72 depends from lid top 36 to provide the contact support of the lid on cap top 20.

Hinge 18 is preferrably of a separable post and slot design with the slots extending thorough the lid top 36 so that the lid 36 may be pivoted to a full 180° open position. A pair of diametrically opposed tabs 35 depend downwardly from cap skirt 22 to lock the closure 10 on the container neck 12 by engagement of the tabs with diameterically opposed slots 37 on the container neck in the same manner as in FIGS. 1–4. In the embodiment shown in FIGS. 5–12 the tabs are located at an angle to a plane which passes through the dispensing orifice and hinge, and this plane is preferrably at 45° to the plane through the dispensing orifice and hinge.

Diametrically opposed pressure points or pads 74 are located at the bottom of cap skirt 22 in a plane normal to a plane through the tabs 35 to supply a child resistant means of removing the base cap 14 from the container neck to empty the last portion of the container contents. As shown by the legend 76 and an arrow 78 in FIG. 10 instructions are given for normal opening of the cap by pressing on the finger push area 68 in the direction of arrow 78 to provide a finger purchase for lifting the lid for normal dispensing through dispensing orifice 24 and nozzle 26. Legend 80 and arrows 82 give instructions to the user for alternately removing the base cap by squeezing at pressure points 74 in the direction of arrows 82 while unthreading the base cap in the direction of arrows 84 as shown in FIG. 11. Directional squeeze arrows 82' in FIG. 11 correspond to the legend arrows 82 in FIG. 10. As the cap skirt 22 is pushed inwardly at opposed points 74, the tabs 35 are lifted out of container slots 37 so that simultaneous turning of the cap in the direction of arrows 84 in FIG. 11 allows unthreading and removal of the base cap. The pressure points or pads 74 extend out in relief from the knurled portion 64 of cap skirt 22 blending into the larger diameter scuff band 88 at the bottom of cap skirt 22 as best seen in FIG. 12. FIG. 12 illustrates how the tabs 35 will lock into slots 37 during the threading on of the base cap 14 in the direction of arrows 86. Sealing of the base cap 14 to container neck 12 is accomplished by contact of annular sealing fin 90, seen in FIG. 8, which depends downwardly from cap top 20 to contact the container neck lip 34 in a fashion similar to gasket 32 as shown in FIG. 4.

The embodiments of the invention in which an exclusive property or privilege is claimed are defined as follows:

1. A dispensing closure for a container neck, comprising, in combination:

a base cap having a top with a dispensing orifice therethrough, an annular skirt depending from the periphery of said top, and means for attachment to said container neck;

a low profile lid having a top wall and a side wall with said side wall conforming with said annular cap skirt and a portion of said lid contacting said cap top when said lid is in a closed position covering said orifice;

a hinge connecting said lid to said cap allowing said lid to be swung between said closed position covering said orifice and an open dispensing position; and an arcuate slot extending through said cap top between said dispensing orifice and said cap skirt, centered in line with said dispensing orifice and hinge;

whereby said cap skirt can be pushed inwardly opposite said slot to expose a portion of the underside of said lid for exerting a lifting force on the lid to swing it from said closed position to said open dispensing position.

2. The dispensing closure according to claim 1 wherein the lid side wall is an annular skirt depending from the periphery of the lid top wall.

3. The dispensing closure according to claim 2 wherein said lid skirt diverges outwardly from said lid top to be in substantial alignment with said annular cap skirt when said lid is in a closed position to prevent grasping the lid in its closed position and exerting an opening force thereon.

4. The dispensing closure according to claim 3 wherein said cap skirt terminates in an annular rim which contacts said lid top when the lid is in a closed position.

5. The dispensing closure according to claim 2 wherein said cap skirt extends upwardly from said cap top to form a recess, and said lid skirt fits inside said recess in said closed position to prevent grasping the lid and exerting an opening force thereon.

6. The dispensing closure according to claim 5 wherein the upwardly extending portion of said cap skirt is formed with an opening opposite said arcuate slot to provide a finger purchase when said cap skirt is pushed inwardly opposite said slot.

7. The dispensing closure according to claim 5 wherein said lid is provided with diametrically opposed ribs depending from said lid top wall which contact said cap top when said lid is in said closed position.

8. The dispensing closure of claim 1 wherein said hinge is a spaced post and slot hinge permitting separate molding of the base cap and lid and assembling together at said hinge.

9. The dispensing closure according to claim 1 wherein said base cap further includes an inner skirt depending from said cap top concentric with said annular skirt, and said means for attachment includes internal threads on said inner skirt for engagement of complementary threads on said container neck.

10. The dispensing closure according to claim 9 wherein said means for attachment includes in addition to said internal threads, means for preventing unthreading of said base cap from said container neck.

11. The dispensing closure according to claim 10 wherein said means for preventing unthreading of said base cap from said container neck includes a tab axially extending from said annular cap skirt which engages a recess in said container neck as said base cap is threaded onto said container neck.

12. The dispensing closure according to claim 11 wherein said means for preventing unthreading of said base cap from said container neck includes a pair of diametrically opposed tabs axially extending from said annular cap skirt which engages recesses in said container neck as said base cap is threaded onto said container neck.

13. The dispensing closure according to claim 12 wherein said diametrically opposed tabs are in a plane normal to a plane through the center of said arcuate slot, dispensing orifice and hinge.

14. The dispensing closure according to claim 12 wherein said diametrically opposed tabs are in a plane at an angle to a plane through the center of said arcuate slot, dispensing orifice and hinge, and pressure spots are provided on the bottom portion of said cap skirt in a plane normal to the plane of said tabs so that said base cap can be removed from said container neck by simultaneously squeezing said pressure spots and unscrewing said base cap.

15. The dispensing closure according to claim 1 wherein said base cap is sealed to said container neck.

16. The dispensing closure according to claim 10 wherein a gasket is interposed between said base cap top and the top of the container neck for sealing said base cap to said container neck.

17. The dispensing closure according to claim 15 wherein an annular sealing fin depends from said base cap top for sealing engagement with the top of said container neck.

18. The dispensing closure according to claim 1 wherein said annular cap skirt has a reduced wall thickness opposite said slot to facilitate inward deflection when said cap skirt is pushed inwardly opposite said slot.

19. The dispensing closure according to claim 1 wherein said arcuate slot is contiguous with said annular cap skirt.

20. The dispensing closure according to claim 19 wherein said cap skirt is provided with an inwardly projecting lip opposite said arcuate slot and said lid skirt superimposes said lip in said closed position.

21. The dispensing closure according to claim 1 wherein said lid is formed with a plug depending from its top engageable with said dispensing orifice to seal said dispensing orifice when said lid is in said closed position.

22. The dispensing closure according to claim 21 wherein said plug cooperates with said dispensing orifice retaining said lid in said closed position to prevent accidental opening thereof.

23. A dispensing closure for attachment to a container having a threaded neck with stop means below said threads comprising, in combination:

a base cap having a top with a dispensing orifice therethrough, an outer cylindrical skirt depending from the periphery of said top, and an inner skirt concentric with said outer skirt depending from said top between said dispensing orifice and said outer skirt;

said inner skirt having internal threads for engagement with said container neck threads, and said outer skirt having a tab extending from its bottom for engagement with said container stop means as said cap is threaded onto said container neck to prevent unthreading thereof;

means for sealing said base cap to said container neck;

a low profile lid having a top with a skirt depending from the periphery thereof contacting said cap top and being substantially aligned with said annular cap skirt when said lid is in a closed position covering said orifice;

a hinge connecting said lid to said top allowing said lid to be swung between said closed position covering said orifice and an open dispensing position;

a plug depending from said lid top for sealingly engaging said orifice and retaining said lid on said base cap in said closed position; and an arcuate slot extending through said cap top between said inner and outer cap skirts centered in line with said dispensing orifice and said hinge;

whereby said cap skirt can be pushed inwardly opposite said slot to expose a portion of the underside of said lid top for exerting a lifting force on the lid to swing it from a closed position to said open dispensing position.

24. A dispensing closure for attachment to a container having a threaded neck with stop means below said threads comprising, in combination:

a base cap having a top with a dispensing orifice therethrough, an outer cylindrical skirt having a lower portion depending from the periphery of said top and an upper portion extending upwardly to form a recess, and an inner skirt concentric with said outer skirt depending from said top between said dispensing orifice and said outer skirt;

said inner skirt having internal threads for engagement with said container neck threads, and said outer skirt having a pair of diametrically opposed tabs extending from the lower portion for engagement with said container stop means as said cap is threaded onto said container neck to prevent unthreading thereof;

means for sealing said base cap to said container neck;

a low profile lid having a top and a skirt depending from the periphery of said lid top and fitting inside said recess and a portion of said lid contacting said cap top when said lid is in a closed position covering said orifice;

a hinge connecting said lid to said top allowing said lid to be swung between said closed position covering said orifice and an open dispensing position;

a plug depending from said lid top for sealingly engaging said orifice in said closed position;

an arcuate slot extending through said cap top between said inner and outer cap skirts centered in line with said dispensing orifice and said hinge; and an opening formed in the upwardly extending portion of said cap skirt opposite said arcuate slot;

whereby said cap skirt can be pushed inwardly opposite said slot to expose a portion of the underside of said lid top at said opening in the upwardly extending portion of said cap skirt for exerting a lifting force on the lid to swing it from a closed position to said open dispensing position.

25. The dispensing closure according to claim 24 further including a pair of diametrically opposed pressure spots on the lower portion of said cap skirt in a plane normal to the plane of said tabs so that said base cap can be removed from said container neck by simultaneously squeezing said pressure spots and unscrewing said base cap.

* * * * *